US009650777B1

(12) United States Patent
Roberts

(10) Patent No.: US 9,650,777 B1
(45) Date of Patent: May 16, 2017

(54) TOILET ASSEMBLY

(71) Applicant: Billy R. Roberts, Lincolnton, NC (US)

(72) Inventor: Billy R. Roberts, Lincolnton, NC (US)

( * ) Notice: Subject to any disclaimer, the term of this patent is extended or adjusted under 35 U.S.C. 154(b) by 0 days.

(21) Appl. No.: 15/175,174

(22) Filed: Jun. 7, 2016

(51) Int. Cl.
*E03D 11/00* (2006.01)
*E03D 11/13* (2006.01)
*E03D 11/02* (2006.01)

(52) U.S. Cl.
CPC ..... *E03D 11/135* (2013.01); *E03D 11/02* (2013.01)

(58) Field of Classification Search
CPC ..... E03D 11/02
USPC ..... 4/300–442, 420–420.5
See application file for complete search history.

(56) References Cited

U.S. PATENT DOCUMENTS

| | | | | |
|---|---|---|---|---|
| 4,185,335 | A | 1/1980 | Alvis | |
| 4,726,079 | A | 2/1988 | Signori et al. | |
| 5,031,251 | A * | 7/1991 | Williams | E03C 1/324 297/330 |
| 5,251,338 | A * | 10/1993 | Light | A47K 13/26 4/235 |
| D453,956 | S | 2/2002 | Elsner | |
| 7,426,756 | B2 | 9/2008 | Clark | |
| 7,900,297 | B2 | 3/2011 | Peng | |
| 8,196,233 | B1 | 6/2012 | Daniels | |

* cited by examiner

*Primary Examiner* — Lori Baker

(57) ABSTRACT

A toilet assembly includes a base that may be positioned on a support surface. A bowl is positioned on the base. The bowl may collect a user's waste. An actuator is coupled between the base and the bowl. The actuator may adjust a height of the bowl with respect to the base. A lever is coupled to the actuator. The lever may actuate and de-actuate the actuator.

9 Claims, 4 Drawing Sheets

TOILET ASSEMBLY

BACKGROUND OF THE DISCLOSURE

Field of the Disclosure

The disclosure relates to toilet devices and more particularly pertains to a new toilet device having an adjustable height.

SUMMARY OF THE DISCLOSURE

An embodiment of the disclosure meets the needs presented above by generally comprising a base that may be positioned on a support surface. A bowl is positioned on the base. The bowl may collect a user's waste. An actuator is coupled between the base and the bowl. The actuator may adjust a height of the bowl with respect to the base. A lever is coupled to the actuator. The lever may actuate and de-actuate the actuator.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
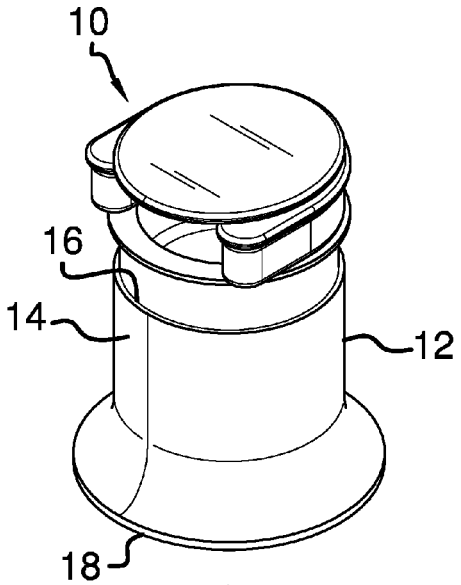
FIG. 1 is a perspective view of a toilet assembly according to an embodiment of the disclosure.
Figure 2:
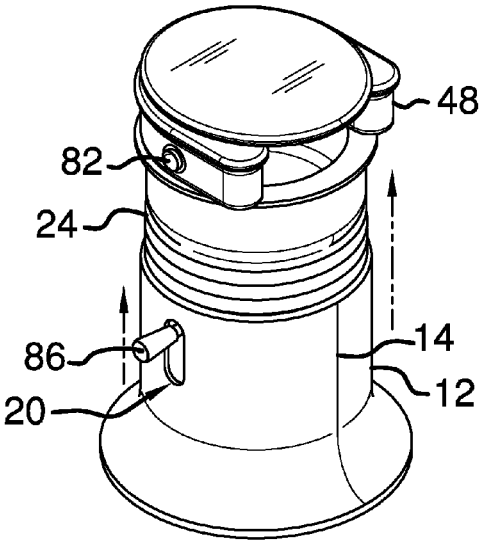
FIG. 2 is a top perspective view of an embodiment of the disclosure.
Figure 3:
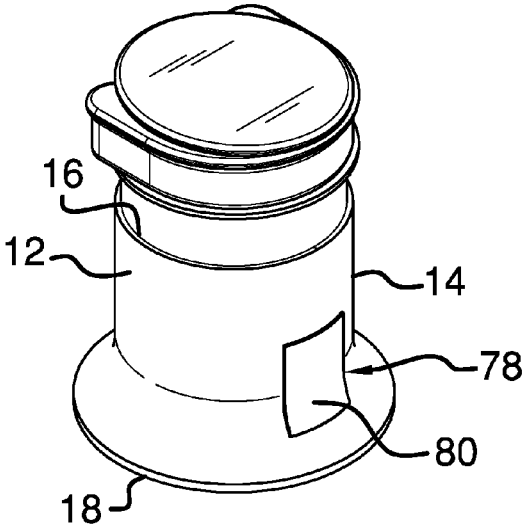
FIG. 3 is a back perspective view of an embodiment of the disclosure.
Figure 4:
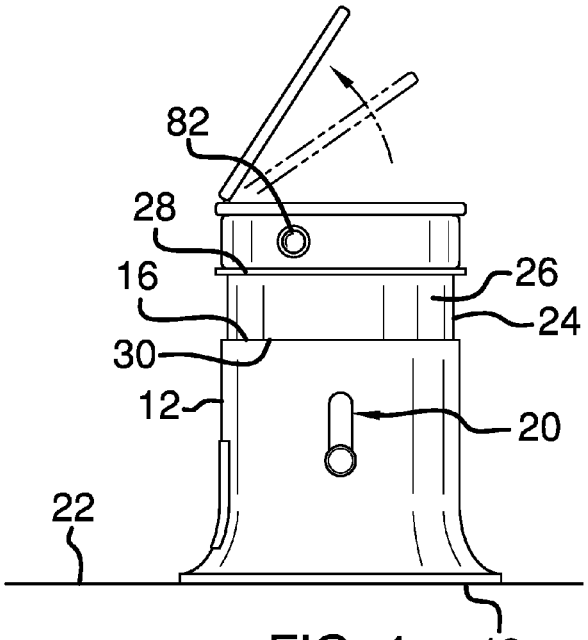
FIG. 4 is a right side view of an embodiment of the disclosure.
Figure 5:
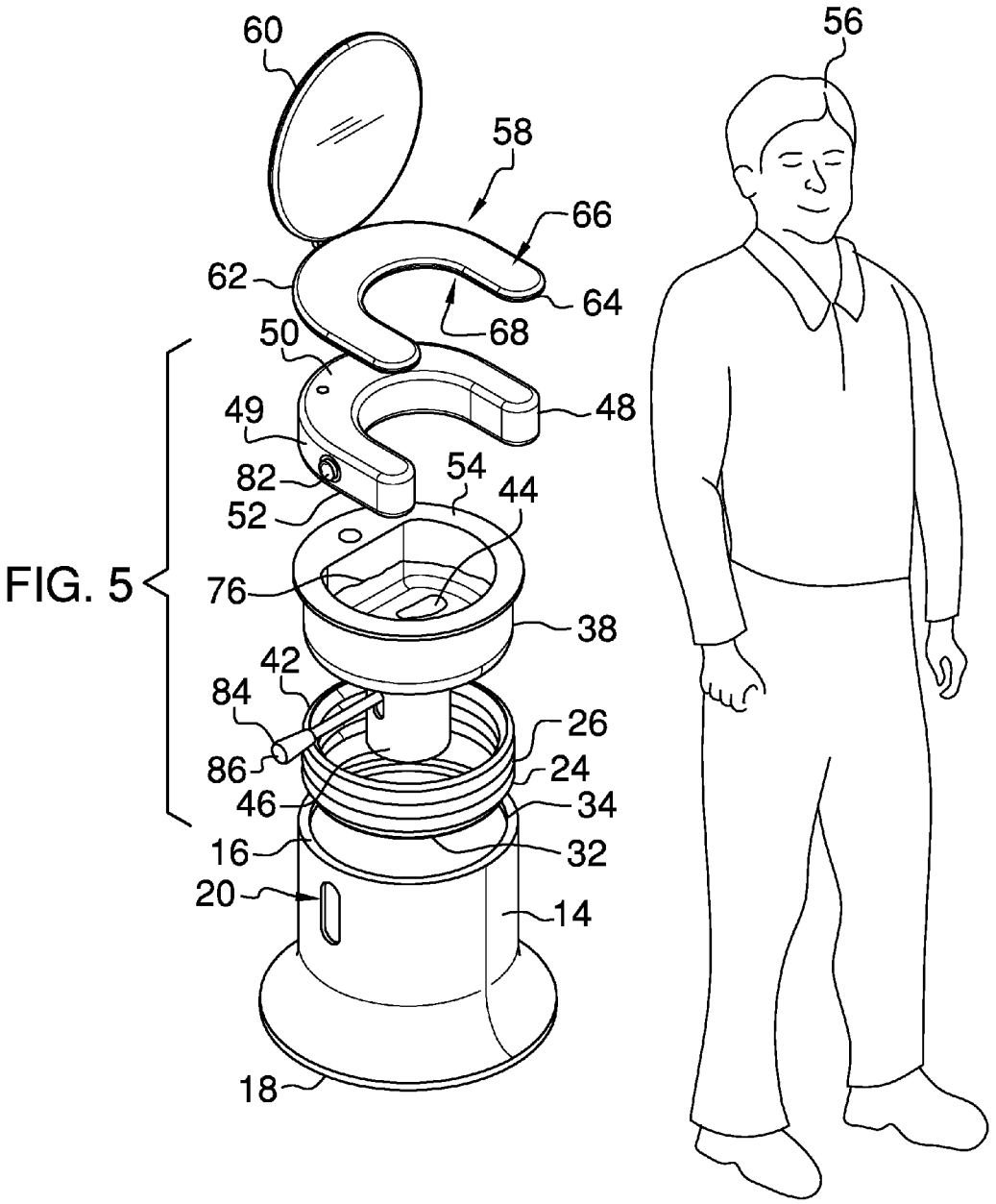
FIG. 5 is an exploded perspective view of an embodiment of the disclosure.
Figure 6:
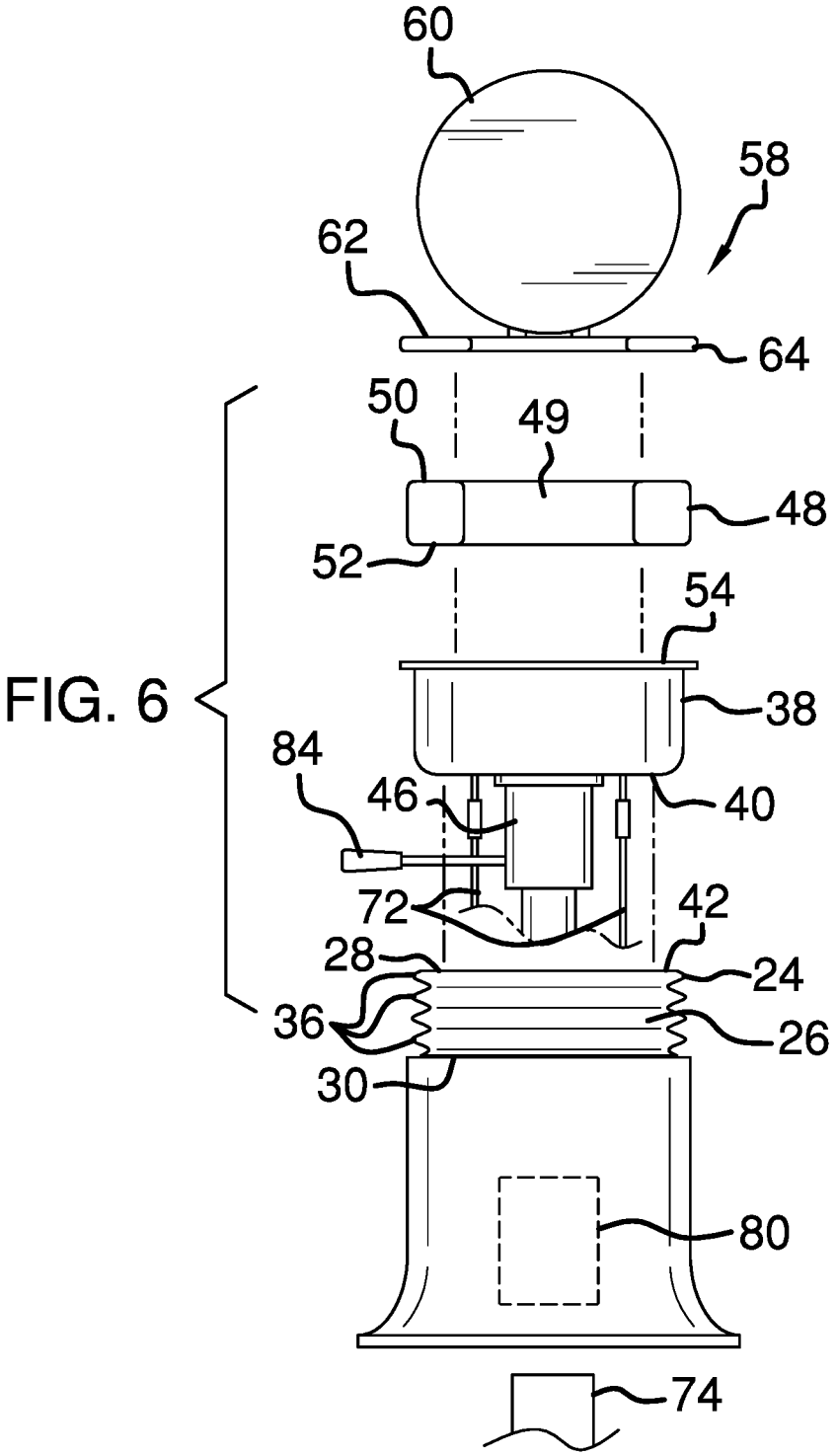
FIG. 6 is an exploded front view of an embodiment of the disclosure.

With reference now to the drawings, and in particular to FIGS. 1 through 6 thereof, a new toilet device embodying the principles and concepts of an embodiment of the disclosure and generally designated by the reference numeral 10 will be described.

As best illustrated in FIGS. 1 through 6, the toilet assembly 10 generally comprises a base 12. The base 12 has an outer wall 14 extending between each of a top side 16 and a bottom side 18 of the base 12. The top side 16 of the base 12 is open. Moreover, the base 12 is substantially hollow.

The base 12 has a lever opening 20 extending through the outer wall 14 of the base 12. The outer wall 14 of the base

12 flares outwardly proximate the bottom side 18 of the base 12. The base 12 is positionable on a support surface 22. The support surface 22 may be a floor.

A shield 24 is provided. The shield 24 has an exterior wall 26 extending between each of an upper end 28 and a lower end 30 of the shield 24. The upper 28 and lower 30 ends of the shield 24 are open. The shield 24 is substantially hollow. A bottom edge 32 of the lower end 30 of the shield 24 is coupled to a top edge 34 of the top side 16 of the base 12.

The exterior wall 26 of the shield 24 comprises a plurality of pleats 36. The pleats 36 are distributed between the upper 28 and lower 30 ends of the shield 24. Additionally, the shield 24 is collapsible to a minimum height and extendable to a maximum height.

A bowl 38 is provided. A bottom wall 40 of the bowl 38 is coupled to an upper edge 42 of the upper end 28 of the shield 24. The bowl 38 is spaced upwardly from the base 12. Additionally, the bowl 38 may collect a user's waste 44.

An actuator 46 is provided. The actuator 46 is coupled between the bottom wall 44 of the bowl 38 and the bottom side 18 of the base 12. The actuator 46 may adjust a height of the bowl 38 with respect to the base 12. Additionally, the actuator 46 may be a pneumatic cylinder of any conventional design.

A seat 48 is provided. The seat 48 has an extraneous wall 49 extending between each of a topmost wall 50 and a bottommost wall 52 of the seat 48. The extraneous wall 49 of the seat 48 is curved so the seat 48 has a U-shape. The bottommost wall 52 of the seat 48 is coupled to a topmost edge 54 of the bowl 38. The seat 48 may support a user 56.

A cover 58 is provided. The cover 58 comprises a lid 60 hingedly coupled to a platform 62. The platform 62 has an extraneous edge 64 extending between each of a top surface 66 and a bottom surface 68 of the platform 62. The extraneous edge 64 of the platform 62 is curved so the platform 62 has a U-shape. The bottom surface 68 of the platform 62 is coupled to the topmost wall 50 of the seat 48. The lid 60 selectively covers and exposes the bowl 38.

A pair of pipes 72 is fluidly coupled between the bottom wall 40 of the bowl 38 and a plumbing system 74. The pair of pipes 72 delivers a fluid 76 into the bowl 38 and drains the fluid 76 and the user's waste 44 from the bowl 38. The fluid 76 may be water. The plumbing system 74 may be a water supply and sewer of any conventional design.

The outer wall 14 of the base 12 has an access opening 78 extending therethrough. The access opening 78 is positioned proximate the bottom side 18 of the base 12. A cover 80 is removably coupled to the outer wall 14 of the base 12. The cover 80 closes the access opening 78. The access opening 78 provides access to the pair of pipes 72 and the actuator 46.

A flushing actuator 82 is coupled to the extraneous wall 49 of the seat 48. The flushing actuator 82 is operationally coupled to the pair of pipes 72. Additionally, the flushing actuator 82 may be engaged by the user 56 to flush the user's waste 44 out of the bowl 38 and into the plumbing system 74.

A lever 84 is provided. The lever 84 is coupled to and extends laterally away from the actuator 46. The lever 84 may actuate and de-actuate the actuator 46. The lever 84 extends through the lever opening 20 so a distal end 86 of the lever 84 with respect to the actuator 46 is accessible to the user 56. The user 56 may adjust a height of the seat 48 with respect to the support surface 22.

In use, the user 56 moves the lever 84 to adjust the height of the seat 48 with respect to the support surface 22. The user 56 utilizes the assembly 10 to urinate and defecate. Additionally, the user 56 engages the flushing actuator 82 to remove the user's waste 44 from the bowl 38.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toilet assembly comprising:

a base configured to be positioned on a support surface, said base having an outer wall extending between each of a top side and a bottom side of said base, said top side of said base being open, said base being substantially hollow, said base having a lever opening extending through said outer wall of said base;

a bowl positioned on said base such that said bowl is configured to collect a user's waste;

an actuator coupled between said base and said bowl such that said actuator is configured to adjust a height of said bowl with respect to said base; and a lever coupled to said actuator such that said lever is configured to actuate and de-actuate said actuator.

2. The assembly according to claim 1, further comprising a shield having an exterior wall extending between each of an upper end and a lower end of said shield, said upper and lower ends of said shield being open, said shield being substantially hollow.

3. The assembly according to claim 2, further comprising:

said base having an outer wall extending between a top side and a bottom side of said base; and a bottom edge of said lower end of said shield being coupled to a top edge of said top side of said base.

4. The assembly according to claim 3, further comprising a bottom wall of said bowl being coupled to an upper edge of said upper end of said shield such that said bowl is spaced upwardly from said base.

5. A toilet assembly comprising:

a base configured to be positioned on a support surface, said base having an outer wall extending between a top side and a bottom side of said base;

a bowl positioned on said base such that said bowl is configured to collect a user's waste;

an actuator coupled between said base and said bowl such that said actuator is configured to adjust a height of said bowl with respect to said base; and a lever coupled to said actuator such that said lever is configured to actuate and de-actuate said actuator;

a shield having an exterior wall extending between each of an upper end and a lower end of said shield, said upper and lower ends of said shield being open, said shield being substantially hollow, a bottom edge of said lower end of said shield being coupled to a top edge of said top side of said base;

a bottom wall of said bowl being coupled to an upper edge of said upper end of said shield such that said bowl is spaced upwardly from said base; and said actuator being coupled between said bottom wall of said bowl and said bottom side of said base.

6. The assembly according to claim 1, further comprising said lever extending laterally away from said actuator such that said lever extends through said lever opening wherein a distal end of said lever with respect to said actuator is accessible to the user.

7. The assembly according to claim 1, further comprising a seat having an extraneous wall extending between each of a topmost wall and a bottommost wall of said seat, said extraneous wall of said seat being curved such that said seat has a U-shape.

8. The assembly according to claim 7, further comprising said bottommost wall of said seat being coupled to a topmost edge of said bowl such that said seat is configured to support a user.

9. A toilet assembly comprising:

a base, said base having an outer wall extending between each of a top side and a bottom side of said base, said top side of said base being open, said base being substantially hollow, said base having a lever opening extending through said outer wall of said base, said base being positionable on a support surface;

a shield having an exterior wall extending between each of an upper end and a lower end of said shield, said upper and lower ends of said shield being open, said shield being substantially hollow, a bottom edge of said lower end of said shield being coupled to a top edge of said top side of said base;

a bowl, a bottom wall of said bowl being coupled to an upper edge of said upper end of said shield such that said bowl is spaced upwardly from said base wherein said bowl is configured to collect a user's waste;

an actuator coupled between said bottom wall of said bowl and said bottom side of said base such that said actuator is configured to adjust a height of said bowl with respect to said base;

a seat having an extraneous wall extending between each of a topmost wall and a bottommost wall of said seat, said extraneous wall of said seat being curved such that said seat has a U-shape, said bottommost wall of said seat being coupled to a topmost edge of said bowl such that said seat is configured to support a user; and a lever, said lever being coupled to and extending laterally away from said actuator such that said lever is configured to actuate and de-actuate said actuator, said lever extending through said lever opening such that a distal end of said lever with respect to said actuator is accessible to the user wherein the user adjusts a height of said seat with respect to the support surface.

* * * * *